United States Patent [19]

Fattori

[11] 4,052,093

[45] Oct. 4, 1977

[54] TELESCOPING ROTARY LATCH AND MANUFACTURE THEREOF

[76] Inventor: Lazzaro A. Fattori, 84 Rose Ave., Woodcliff Lake, N.J. 07680

[21] Appl. No.: 705,520

[22] Filed: July 15, 1976

[51] Int. Cl.[2] ..... E05C 3/10

[52] U.S. Cl. ..... 292/218

[58] Field of Search ..... 292/59, 68, 251, 336.3, 292/DIG. 38; 206/403; 70/208

[56] References Cited

U.S. PATENT DOCUMENTS

| | | | |
|---|---|---|---|
| 3,297,153 | 1/1967 | Fattori | 206/403 |
| 3,299,678 | 1/1967 | Spencer | 292/251 X |
| 3,568,263 | 3/1971 | Meehan | 85/72 |
| 3,744,828 | 7/1973 | Goldberg | 292/59 |

FOREIGN PATENT DOCUMENTS

| | | | |
|---|---|---|---|
| 338,102 | 6/1921 | Germany | 292/59 |

*Primary Examiner*—Richard E. Moore

[57] ABSTRACT

A rotary latch has an upstanding finger grip for rotating the latch to open and closed positions normally located in a well, recessed below a surface of a container. The latch is formed as a two-piece combination, the finger grip terminating a telescoping inner member adapted to rotate with an outer member which provides the latching means and to be extended to position the finger grip above the container surface facilitating rotation of the latch. The two pieces are molded as an integral unit in tandem axial alignment interconnected by a pair of webs, which, by axial compression of the molded unit, are severed for automatic prealigned telescoping assembly and operative engagement of the inner and outer members into the two-piece latch.

12 Claims, 7 Drawing Figures

TELESCOPING ROTARY LATCH AND MANUFACTURE THEREOF

BACKGROUND OF THE INVENTON

1. Field of the Invention

The invention relates to finger maniuplated rotary latches having a finger grip positioned in a seat or well formed as a depression in the cover of a shipping and storage container for reels of motion picture film or magnetic tape and normally recessed below the exterior surface of the container and more particulary is directed to a two-piece telescoping molded latch having the finger grip extendable for use above the container surface and to automatic assembly of the two-piece latch from a unitary integrally molded piece.

2. Description of the Prior Art

The state of the art is best respresented by my prior U.S. Pat. No. 3,297,153, granted Jan. 10, 1967 and entitled Shock Resistant Plastic Containers With Self-Contained Locking Means. Film shipping and storage cases having the four corner rotary latches as disclosed in this patent has been well received and presently enjoys widespread use in trade. Difficultly in manipulating the latches which have their finger grips located in the tight quarters of the recessed wells has been experienced by those having weakness in their fingers or those suffering from arthritis in the finger joints. A need has been expressed to make such finger grips more accessible for manipulation.

SUMMARY OF THE INVENTION

Among the objects of the invention is to satisfy the need hereinbefore stated by providing a rotary latch comprising a telescoping inner member terminating in a finger grip for extension of the latter above and beyond the well in which such latch is normally recessed when not in use and providing for locking the finger grip in fully retracted position against accidental extension. The latch shall also be capable of manufacture by low coast quantity molding methods and require minimum labor costs for assembly.

The invention defines an outer tubular member having a rectangular bore receiving a telescoping inner member terminating in a finger grip projecting above a circular flange formed at the upper end of the outer member. The axial bore has an upper portion sized in cross-section to conform to and slidingly receive the inner member and a lower portion of larger cross-section along one axis thereof sized to accommodate an enlarged end of the inner member. An interior shoulder provided between the bores engages an exterior shoulder provided by the inner member enlarged end as a stop limiting extension of the inner member and finger grip. A pair of protuberances extending into the upper bore portion engage transverse ribs formed by depressions in the inner member providing snap-in means for retaining the latter and finger grip in a fully retracted position. An integral molded piece with the members in tandem axial alignment wherein the enlarged lower end of the inner member is connected by a pair of webs to the upper end of the outer member permits automatic assembly by axial compression whereby the webs are severed and the enlarged lower end, being suitably grooved and beveled, is compressed to fit and pass through the upper bore portion and expand to normal size when entering the enlarged bore portion.

DESCRIPTON OF THE PREFERRED EMBODIMENT

Figure 1:
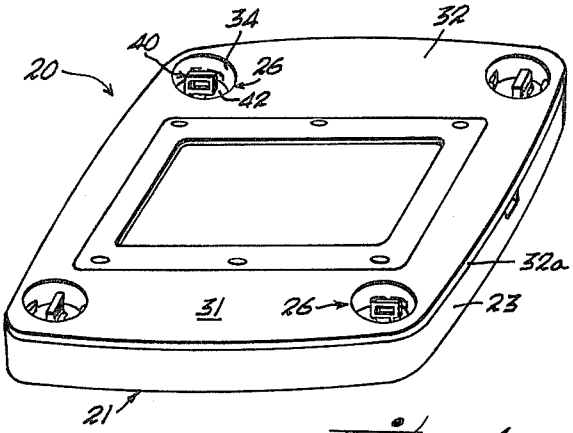
FIG. 1 is a perspective top view of a film shipping case having four corner latching devices, each incorporating the telescoping rotary latch with the extendable finger grip embodying the invention.

Referring in detail to the drawing, 20 generally denotes a shipping container or case seen to comprise an open box or container portion 21 having a fitted cover 31 and four corner latching devices, generally designated as 26, cooperating therebetwen. Box 21 has a flat bottom wall 22 and an upstanding peripheral side wall 23 which forms an exterior side wall for case 20. Fitted cover 31 has a flat top wall 32 which is sized and shaped to conform to the contour of the open box 21 and to have a periphery flush with the exterior surface of side wall 23. A side wall 33, extending from top wall 32, is spaced inwardly of the periphery thereof to telescope into side walls 23 and provide a peripheral overhang **32*a* for engaging the upper free end of side wall 23 as a butt joint closure for case 20.**

Figure 4:
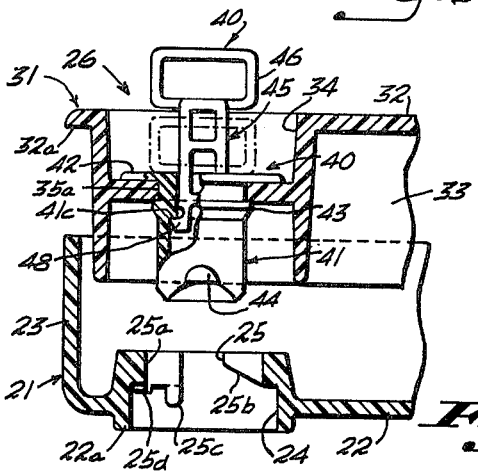
FIG. 4 is a sectional view of the corner of the case taken on line 4—4 in FIG. 2 but with the container portion and cover of the case shown in exploded position, the finger grip and inner member being shown in full lines in fully extended position and indicated in broken lines in retracted position, parts of the rotary latch being broken away to show interior structure.

As seen in FIG. 4, the four corner latching devices 26 each comprises a seat or well 24 integrally formed as an upward depression in bottom wall 22 and a companion seat or well 34 integrally formed as a downward depression in top wall 32. Wells 24 and 34 are in registered alignment with each other when cover 31 closes box 21 and have their respective bottoms spaced from each other and formed with diametric slots 25 and 35, each having a central enlargement **25*a* and 35*a*, respectively, which are in registered alignment to receive rotary latch 40** therethrough.

Figure 3:
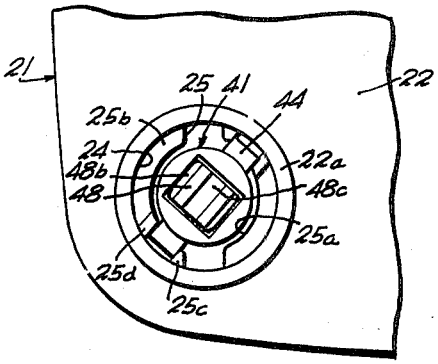
FIG. 3 is a bottom view of the corner shown in FIG. 2 but with the rotary latch in locked position.

The downfacing surface of the bottom of well 24 bordering slot 25 and enlargement **25*a* is formed as a pair of diametric cam surfaces 25*b* which are inclined toward bottom wall 22 in a counter-clockwise direction, as seen in FIG. 3, from the bottom of the incline adjacent slot 25 to the top of the incline terminated by a stop or boss 25*c* extending from the side wall of well 24. A snap-over rise 25*d* in the cam surface 25*b* is spaced from boss 25*c*, the latter and rise 25*d* forming a snap-in-cradle therebetween for seating latching element 44 of rotary latch 40** in locked position.

Figure 2:
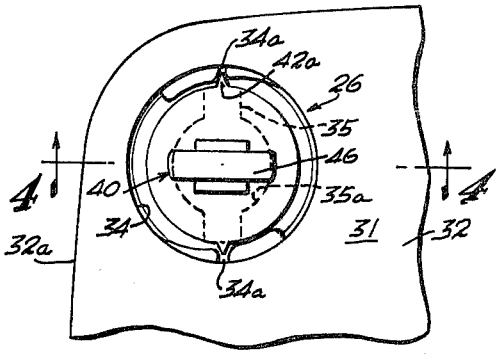
FIG. 2 is a fragmentary top plan view of the rear left corner of the case shown in FIG. 1 with the rotary latch in open position.
Figure 7:
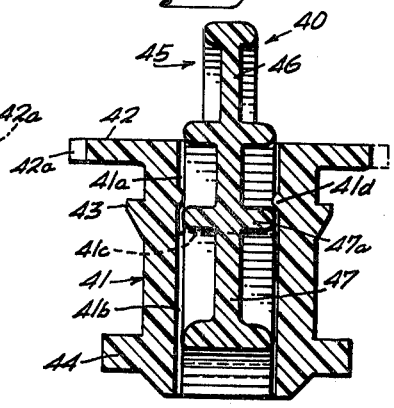
FIG. 7 is a sectional view similar to FIG. 6 but showing the rotary latch assembled and in fully retracted position.

Rotary latch 40 is a two-piece assembly comprising an outer tubular body or member 41 and an inner member 45 which telescopes into an axial bore of member 41 except for a diametrically disposed and upstanding flange serving as finger grip 46. Outer member 41 is diameterically sized to fit through center enlargements 25*a* an 35*a* and terminates at the upper end adjacent finger grip 46 in a radially extending circular flange 42 sized to seat in well 34. A pair of diametrically opposed pointed projections 42*a* extend beyond the periphery of flange 42 in right anuglar relation to finger grip 46 and selectively engage an indexing means formed as notches 34*a* in tapered, cam-like projections from the side wall into well 34 as seen in FIG. 2. A retaining ring or shoulder 43, which is spaced below flange 42 a distance substantially equal to the thickness of the bottom of well 34, is seen in FIGS. 4 and 7 as being wedge-shaped in cross-section to provide a beveled surface for facilitating initial passage through center enlargement 35*a* snap-in engagement and retention of latch 40 in well 34. The end portion of outer member 41 opposite circular flange 42 has a pair of diametrically aligned lateral projections serving as latching elements 44 for rotary latch 40. Elements 44 are seen in FIG. 4 to be semi-circular in cross-section to provide a smooth, curved surface for slidingly engaging cam surfaces 25*b* and easily snapping over rises 25*d.*

Figure 5:
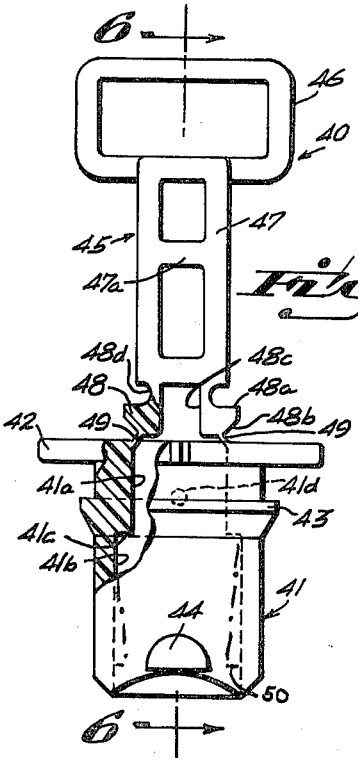
FIG. 5 is an elevational view of the rotary latch as an intergal molded unit prior to assembly with the two members in axial and radial alignment and connected by severable webs.

The interior structure of outer member 41 includes a non-circular axial bore having a square cross-section in the upper porton 41*a* thereof which, as shown in FIG. 5, widens, along one dimension, namely, on the axis perpendicular to the radial axis of pointed projections 42*a* and latching elements 44, at a pair of opposite aligned shoulders 41*c* to form an enlarged lower bore portion 41*b* of rectangular cross-section. Within upper bore portion 41*a* on the walls adjacent shoulders 41*c* are a pair of diametrically aligned rounded protuberances 41*d* which coact with intermediate transverse ribs 47*a* of inner member 45 as hereinafter more fully described.

Inner member 45 comprises an intermediate shank 47 having an overall square cross-sectional area sized to slidingly fit upper bore portion 41*a* of outer member 41 and has one pair of opposite sides thereof cut out as upper and lower depressions separated by transverse ribs 47*a* which face the walls of upper bore portion 41*a* bearing proturberances 41*d.* Shank 47 terminates at the upper end in finger grip 46 which extends laterally beyond the cross-sectional area thereof and, as seen in FIG. 7, has a thickened strengthening border. The lower end of shank 47 opposite finger grip 46 extends as a pair of hook-like members 48 which project beyond the pair of opposite sides of shank 47 adjacent the pair of sides having transverse rib 47*a* as exterior shoulders 48*a,* the latter providing an overall cross-sectional area fitting enlarged lower bore portion 41*b* of outer member 41 and engaging interior shoulders 41*c* as a stop means when inner member 45 is fully extended as seen in FIG. 4. The end of shank 47 has a diametric groove 48*c,* which separates hook-like members 48 from each other, and a pair of side grooves 48*d,* the latter and groove 48*c* cooperating with beveled surfaces 48*b* formed on the free ends of members 48 to permit flexing thereof in a medial direction during assembly.

The operation of case 20 with the four corner latching devices 26 will be seen to be generally similar to that described in my said prior patent, such as, the indexing of any corner of cover 31 with any corner of box 21, the locking of rotary latch 40 in open position by pointed projections 42*a* of circular flange 42 snapping into notches 34*a,* and the manner in which devices 26 lock and unlock, and also seen to include the improved features of the two-piece rotary latch 40 providing telescoping finger grip 46.

Accordingly, to lock and unlock devices 26, there is the option of either manipulating finger grip 46 to rotate latch 40 while in the fully retracted position wherein inner member 45 is normally retained by protuberances 41*d* engaging transverse ribs 47*a* as is clear from FIG. 7, or by pulling upwardly on finger grip 46 to extend inner member 45 so that finger grip 46 projects above the surface of top wall 32 of cover 31 for complete accessibility. This is accomplised by transverse ribs 47*a,* aided by their rounded contour, snapping over protuberances 41*d* when the pulling force is applied so that shank 47 is relatively free to slide upwardly until exterior shoulers 48*a* of hook-like members 48 engage interior shoulders 41*c.*

After use of finger grip 46 in extended position to unlock and particularly after locking rotary latch 40, finger grip 46 is retracted by applying downward finger pressure so that transverse ribs 47*a* snap over protuberances 41*d* and finger 46 contacts circular flange 42 as seen in broken lines in FIG. 4.

Figure 6:
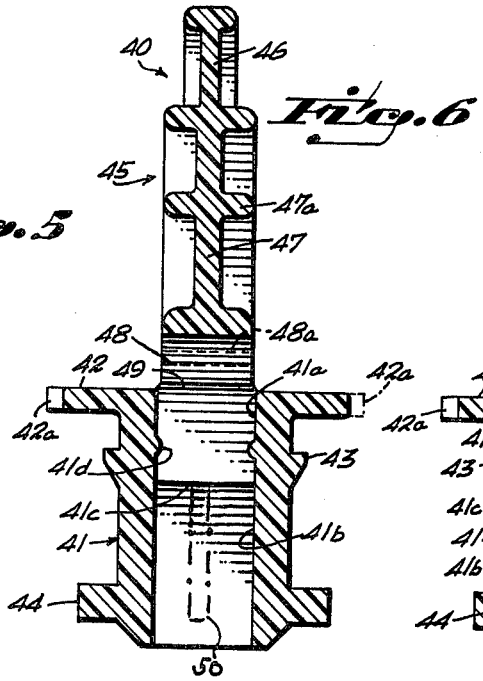
FIG. 6 is a sectional view taken on line 6—6 in FIG. 5.

The integral structure whereby outer member 41 and inner member 45 are molded of a suitable resinous plastic material, such as nylon, in prealigned relation for automatic assembly is shown in FIGS. 5 and 6. Inner member is molded in both axial and radial alignment with respect to outer member 41 and is connected thereto by a pair of webs 49 which extend from the upper ends of the pair of opposite walls of upper bore portion 41*a,* the inner ends of which terminate in interior shoulders 41*c,* to the bottom edges of of beveled surfaces 48*b* of hook-like members 48. After molding said integral structure, axial compression is applied to the opposite ends thereof which severs webs 49, that is, tears hook-like members 48 from the outer member 41 along webs 49 and simultaneously forces beveled surfaces 48*b* into upper bore portion 41*a* whereby hook-like members 48 flex medially, narrowing groove 48*c* and permitting exterior shoulders 48*a* to slide through upper bore portion 41*a.* Upon clearing interior shoulders 41*c* and entering enlarged lower bore portion 41*b,* hook-like members 48 spring back into normal position completing the automatic assembly of rotary latch 40. Additional pressure exerted for telescoping movement of inner member 45 will cause transverse ribs 47*a* to snap over protuberances 41*d* into the fully retracted, locked position shown in FIG. 7. Rotary latch 40 is then ready for assembly in a suitable fastening device, such as, but not limited to, device 26 in case 20.

The two-piece telescoping molded rotary latch providing the extendable finger grip and the integral molded piece aligning the two members for automatic assembly while simultaneously being split apart in a relatively hand labor free manner is seen to achieve the several objects of the invention and to be well adapted to meet conditions of pracitical use. As various possible embodiments might be made in the above invention, and as various changes might be made in the disclosed construction, it is to be understood that all matter herein set forth or shown in the accompanying drawing are to be interpreted as illustrative and not in a limiting sense.

For example, referring to FIGS. 5 and 6, in place of the pair of diametrically aligned rounded protrubernaces 41*d* which coact with intermediate transverse ribs 47*a* of inner member 45, as described, I may substitute a pair of axially directed ribs on those inner walls of the outer member 45 toward which the hook like members 48 spring when clearing, on assembly as described, the interior shoulders 41*c*. The axially directed ribs are preferably tapered inwardly from the radially outermost ends of the interior shoulders 41*c* toward the bottom end of the outer member (as viewed in FIGS. 5 and 6) but spaced therefrom a sufficient distance to permit the hook-like members to be moved beyond the terminus of these axially directed ribs and still be housed within the confines of the outer member or at least flush with the bottom end thereof. As in the described embodiment, once the inner member 40 is assembled within the outer member 45, the interior shoulders 41*c* act as a stop means in association with the exterior shoulders 48*a* of the inner members to prevent the latter from being removed. The tapered ribs are dimensioned to provide progressive sliding, fricitional engagement wih the exterior shoulders 48*a* until the latter clear the terminus of these ribs, as described. FIGS. 5 and 6 show in phantom lines where the ribs 50 would be disposed if the transverse ribs were replaced.

What is claimed is:

1. In a latching device for fastening a first component having a surface and a well recessed therefrom to a second component having a slot with a center enlargement in registered alignment with said well, a two-piece rotary latch for securing for rotation in the bottom of said well and having means for projecting through said bottom and through said slot and center enlargement adapted to engage borders of said center enlargement on rotation of the rotary latch to fasten said components together, said rotary latch comprising an inner member mounted to turn with and telescope into an axial bore of an outer member, said border engaging means being integrally formed on said outer member as radially projecting latching elements said inner member terminating in a finger grip for rotating said latch, said finger grip normally being recessed from said surface when in fully retracted position and projecting above said surface for accessibility when in extended position, and snap-in means having elements integrally formed with said members coacting between the outer member bore and said inner member retaining the latter in said fuly retracted position against accidental extension of the inner member and projection of said finger grip above said surface when the finger grip is not in use.

2. In the latching device defined in claim 1, in which said axial bore has an interior shoulder formed between an upper bore portion and a lower bore portion of enlarged cross-section, the lower end of said inner member opposite said finger grip having means sized to fit said enlarge bore portion and to engage said shoulder when in said fully extended position and being compressible to fit into and pass through said upper bore portion when assembling the two members by inserting said lower end means in compressed condition into the upper end of said upper bore portion.

3. In the latching device defined in claim 1, in which said snap-in means for retaining the inner member in said fully retracted position comprises a pair of opposing rounded proturberances projecting into said axial bore to engage a pair of transverse ribs formed along opposite surfaces of the inner member by upper and lower cut out depressions.

4. A two part structure molded of resinous plastic material as an integral unitary structure, a first part comprising an outer tubular member having a non-circular axial bore formed as an upper portion and an enlarged lower bore portion, a second part comprising an intermediate shank having an overall cross-section sized to slidingly fit said upper bore portion and an enlarged lower end having a cross-section sized to slidingly fit said lower enlarged bore portion, said two parts being connected in tandem axial alignment by a pair of webs extending between an upper end of said first part and said second part enlarged lower end, said webs and adjacent portions of said two parts being constructed and arranged for simultaneous disjoining and telescoping into an assembled condition by axial compression applied to opposite ends of said integral unitary structure which severs said webs and compresses said enlarged lower end to fit and pass through said bore portion and expand to normal size in said enlarged lower bore portion.

5. The integral unitary structure defined in claim 4, in which said non-circular bore is rectangular in cross-section and said lower portion is enlarged with respect to the upper bore portion by an interior shoulder formed transversely on a first pair of opposite walls of the bore.

6. The integral unitary structure defined in claim 5, in which said intermediate shank conforms to said upper bore portion rectangular cross-section and terminates at an upper end in an upstanding flange which radially extends beyond said shank cross-section as a finger grip for said second part, and in which said enlarged lower end extends from a pair of opposite side walls parallel to said first pair of opposite walls of said bore to form a pair of exterior shoulders adapted to engage said interior shoulders as a stop after assembly when said second part is in a fully extended position.

7. The integral unitary structure defined in claim 6, in which a diametric groove is formed in the free end of said second part enlarged lower end and extends parallel to said pair of opposite side walls, said groove dividing said enlarged end into a pair of spaced hook-like members adpated to be brought closer together by said compression during said assembly.

8. The integral unitary structure defined in claim 7, in which each of said hook-like members has a beveled surface to which one of said webs connects, said beveled surfaces facing said first pair of opposite walls of the bore for engagement therewith to effect said enlarged end compression during said assembly.

9. The integral unitary structure defined in claim 6, in which a second pair of opposite walls in said upper bore portion is formed with a pair of proturberances projecting into said axial bore, a second pair of opposite side walls of said intermediate shank having upper and lower cut out depressions forming transverse ribs, said proturberances and transverse ribs engaging to provide a snap-in means when the parts are assembled for retaining the second part in a fully retracted position in said first part and coacting with said upstanding flange which serves as a stop against further retraction.

10. The integral unitary structure defined in claim 8, in which said intermediate shank is formed with a transverse groove formed as a recess from each of said exterior shoulders, said transverse grooves providing flexbility to said hook-like members and coacting with said end groove and beveled surfaces to effect said compression during said assembly.

11. The integral unitary structure defined in claim 6, in which said first pair of opposite walls of said lower bore each has an axially extending rib which is tapered radially inwardly and downwardly and terminates short of the lower end of said enlarged lower bore portion whereby telescoping sliding engagement between said first and second parts progessively compresses said second part exterior shoulder until reaching a fully retracted position wherein the lower ends of said ribs are cleared releasing said exterior shoulders for snap-in engagement retaining said second part in a fully retracted position in said first part and coacting with said upstanding flange which serves as a stop against further retraction.

12. In the latching device defined in claim 2, in which said snap-in means for retaining the inner member in said fully retracted position comprises a pair of axially directed ribs extending along opposite walls of said lower bore portion, each rib being tapered radially inwardly and downwardly and terminates short of the lower end of said outer member whereby telescoping sliding engagement progressively compresses said inner member to a lesser degree than required for passing through said upper bore until reaching a fully retracted position wheren the lower ends of said ribs are cleared releasing the compression for snap-in engagement.

* * * * *